US006038533A

United States Patent [19]

Buchsbaum et al.

[11] Patent Number: 6,038,533

[45] **Date of Patent: *Mar. 14, 2000**

[54] SYSTEM AND METHOD FOR SELECTING TRAINING TEXT

[75] Inventors: Adam Louis Buchsbaum, Cranford, N.J.; Jan Pieter VanSanten, Brooklyn, N.Y.

[73] Assignee: Lucent Technologies Inc., Murray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/499,159

[22] Filed: Jul. 7, 1995

[51] Int. Cl.[7] ..... G10L 5/02; G10L 4/00

[52] U.S. Cl. ..... 704/260; 704/255

[58] Field of Search ..... 395/2.67, 2.69, 395/2.58, 2.63, 2.64–2.66

[56] References Cited

U.S. PATENT DOCUMENTS

| | | | |
|---|---|---|---|
| 4,979,216 | 12/1990 | Malsheen et al. | 395/2.67 |
| 5,204,905 | 4/1993 | Mitone | 395/2.67 |
| 5,230,037 | 7/1993 | Giustiani et al. | 395/2 |
| 5,268,990 | 12/1993 | Cohen et al. | 395/2 |
| 5,581,655 | 12/1996 | Cohen et al. | 395/2.54 |

OTHER PUBLICATIONS

Van Santen, J P H "Perceptual Experiments for Diagnostic Testing of Text to Speech Systems", Computer Speech and Language, vol. 7, No. 1., Jan. 1, 1993 pp. 49–100, XP000354661, Abstract paragraph 2.1.2.

Van Santen, J P H et al. "The Analysis of Contextual Effects on Segmental Duration"; Computer Speech and Language, vol. 4, No. 4., Oct. 1, 1990, pp. 359–390, XP000202888, Abstract, Paragraphs 3.1 and 3.2.

Macarron, A et al. "Generation of Duration Rules for Spanish Text to Speech Synthesizer", Eurospeech 91, 2nd European Conference on Speech Communication and Technology Proceedings, Genova, Italy, Sep. 24–26, 1991, Genova, Italy, Instituto Int. Comunicazioni, Italy, pp. 617–620, XP002041371, Abstract paragraph 5.

Olive, J.P. and Sproat, R.W., "Text–To–Speech Synthesis," *AT&T Technical Journal*, vol. 74, pp. 35–44, 1995.

VanSanten, "Assignment of Segmental Duration In Text–To–Speech Synthesis," *Computer Speech and Language*, vol. 8, pp. 95–128.

Olive, J.P., Greenwood, A., and Coleman, J. "*Acoustics of American English Speech*," Springer–Verlag, New York, 1993.

Roussas, E.G., *A First Course In Mathematical Statistics*, Addison–Wesley Publishing Company, Reading, MA, 1973.

Welsh, D.J.A. *Matroid Theory*, Academic Press, 1976.

Tarjan, R.E. *Data Structures and Network Algorithms*, CBMS–NSF Regional Conference Series in Applied Mathematics, society for Industrial and Applied Mathematics, Philadelphia, PA, 1993.

(List continued on next page.)

*Primary Examiner*—Forester W. Isen
*Assistant Examiner*—Patrick N. Edouard

[57] ABSTRACT

A system and method are described for determining a near-optimum subset of data, based on a selected model, from a large corpus of data. Sets of feature vectors corresponding to natural or other preselected divisions of the data corpus are mapped into matrices representative of such divisions. The invention operates to find a submatrix of full rank formed as a union of one or more of those division-based matrices. A greedy algorithm utilizing Gram-Schmidt orthonormalization operates on the division matrices to find a near optimum submatrix and in a time bound representing a substantial improvement over prior-art methods. An important application of the invention is the selection of a small number of sentences from a corpus of a very large number of such sentences from which the parameters of a duration model for speech synthesis can be estimated.

31 Claims, 3 Drawing Sheets

OTHER PUBLICATIONS

Kruskai, J.R. "On the Shorteset Spanning Subtree of a Graph and the Traveling Salesman Problem," *Proceedings of the American Mathematical Society*, vol. 7, pp. 53–57, 1956.
Nemhauser and Wolsey, *Interger and Combinatorial Optimization*, John wiley & Sons, 1988.
Greene, D.R. and Knuth, D.E. *Mathematics of the Analysis of Algorithms*, Birkhauser, Boston, second edition, 1982.
Garey, M.R,. and Johnson, D.S. *Computers and Intractability: A Guide to the Theory of NP–Completeness*, W.H. Freeman and Company, New York, 1979.
Lund and Yannakakis, "On the Hardness of Approximating Minimization Problems," (extended abstract), *Proc. 25th ACM Symp. on theory of Computing, pp. 286–293, 1993*.
Golub, G. H. and van Loan, C.F. *Matrix Computations*, Johns Hopkins Series in the Mathematical Sciences, Johns Hopkins University Press, Baltimore, second edition, 1989.

Barnett, S. *Matrices, Methods, and Applications*, Oxford Applied Mathematics and Computing Science Series, Clarendon Press, Oxford, 1990.

van Santen, J.P., "Assignment of segmental duration in text–to–speech synthesis", *Computer Speech and Language* (1994) 8, 95–128.

Sproat, et al., "Text–to–Speech Synthesis", AT&T Technical Journal (To appear).

TWO FACTOR INCIDENCE MATRIX

| | TOTALLY STRESSED | SOMEWHAT STRESSED | UNSTRESSED |
|---|---|---|---|
| VOWEL 1 | | | |
| VOWEL 2 | | | |
| VOWEL 3 | | | |
| ⋮ | | | |
| VOWEL n | | | |

SYSTEM AND METHOD FOR SELECTING TRAINING TEXT

FIELD OF THE INVENTION

This invention relates to speech synthesis systems and more particularly to the selection of training text for such systems.

BACKGROUND OF THE INVENTION

In the art of speech synthesis, a great deal of data is required for the speech style to be emulated in order to approximate a human-like synthesis. The problem can be illustrated by reference to a rudimentary, and generally familiar means for producing a voiced response to a textual or keyboard input—specifically those systems which provide a voiced response (generally comprised of concatenated prerecorded digits corresponding to an electronically stored number or confirming a number entered via a keyboard or keypad) to various telephone inquires, such as a request to a directory assistance operator or an interface with an automated banking function. As is well known, such systems are characterized by a very limited vocabulary—often only the digits from 0 to 9, a staccato delivery style, generally very brief speech response, and the necessity that each "word" in the system's vocabulary be prerecorded and stored. In this respect, it is readily seen that such rudimentary voice response systems do not provide true speech synthesis inasmuch as the only synthesis involved is the stringing together of a series of prerecorded numerals, words or phrases.

For speech synthesis systems operating on open input, such as a system for translating a computer text file for a sight impaired user, the limitations described above will generally be intolerable. For example, the working vocabulary of such a system must be at least in the tens of thousands of words. And, many of those words will require different inflection, accentuation and/or syllabic stress, depending on context. It will readily be appreciated that the task of recording, storing and recalling the necessary vocabulary of words (as well as the task of recognizing which stored version of a particular word is required by the immediate context) would require immense human and computational resources, and as a practical matter could not be implemented. Similarly, in order to make synthesized speech of more than a few words acceptable to users, it must be as human-like as possible. Thus, the synthesized speech must include appropriate pauses, inflections, accentuation and syllabic stress. Obviously, the staccato delivery style of the rudimentary system would be unacceptable.

Put somewhat differently, speech synthesis systems which can provide a human-like delivery quality for non-trivial input textual speech must not only be able to handle the necessary vocabulary size but also must be able to correctly pronounce the "words" read, to appropriately emphasize some words and de-emphasize others, to "chunk" a sentence into meaningful phrases, to pick an appropriate pitch contour and to establish the duration of each phonetic segment, or phoneme—recognizing that a given phoneme should be longer if it appears in some positions in a sentence than in others. Broadly speaking, such a system will operate to convert input text into some form of linguistic representation that includes information on the phonemes to be produced, their duration, the location of any phrase boundaries and the pitch contour to be used. This linguistic representation of the underlying text can then be converted into a speech waveform.

We believe that the state of the art in speech synthesis is represented by a text to speech (TTS) synthesis system developed by AT&T Bell Laboratories and described in Olive, J. P. and Sproat, R. W., "Text-To-Speech Synthesis", *AT&T Technical Journal,* 74: 35–44, 1995. We will refer to that AT&T TTS System from time-to-time herein as a typical speech synthesis embodiment for the application of our invention.

It is not necessary to describe in detail the operation of such speech synthesis systems, which, in general, are known in the art, but a functional description of such systems will aid in the understanding of our invention. In FIG. 1 such a system is depicted in broad functional form. As shown in the figure, input text is first operated on by a Text Analysis function, 1. That function essentially comprises the conversion of the input text into a linguistic representation of that text. Included in this text analysis function are the subfunctions of identification of phonemes corresponding to the underlying text, determination of the stress to be placed on various syllables and words comprising the text, application of word pronunciation rules to the input text, and determining the location of phrase boundaries for the text and the pitch to be associated with the synthesized speech. Other, generally less important functions may also be included in the overall text analysis function, but they need not be further discussed herein.

Following application of the text analysis function, the system of FIG. 1 performs the function depicted as Acoustic Analysis 5. This function will be concerned with various acoustic parameters, but of particular importance to the present invention, the Acoustic Analysis function determines the duration of each phoneme in the synthesized speech in order to closely approximate the natural speech being emulated. This phoneme duration aspect of the Acoustic Analysis function represents the portion of a speech synthesis system to which our invention is directed and will be described in more detail below.

The final functional element in FIG. 1, Speech Generation, 10, operates on data and/or parameters developed by preceding functions in order to construct a speech waveform corresponding to the text being synthesized into speech. For purposes of our discussion, it is important to note that the Speech Generation function operates to assure that the speech waveform for each phoneme corresponds to the duration for that phoneme determined by the Acoustic Analysis function.

It is well known that, in natural speech, the duration of a phonetic segment varies as a function of contextual factors. These factors include the identities of the surrounding segments, within-word position, word prominence, presence of phrase boundaries, as well as other factors. It is generally believed that for synthetic speech to sound natural, these durational patterns must be mimicked. To realize these durational patterns in a synthesizer, the Acoustic Analysis function operates on parameters derived from test speech read by a selected speaker. From an analysis of such test speech, and particularly phoneme duration data obtained therefrom, speech synthesis systems can be constructed to essentially emulate the durational patterns of the selected speaker.

The test speech will contain a number of preselected sentences read by the selected speaker and recorded. This recorded test speech is then analyzed in terms of the durations of the individual phonemes contained in the spoken test sentences. From this data, rules are developed for predicting the durations of such phonemes in text which is to be synthesized into speech, given a context in which the words containing such phonemes appear. While the general character of such rules is known for at least the major languages, based on a large body of prior research into speech characteristics—which research has been widely reported and will be well known to those skilled in the art of speech synthesis, it is necessary to adapt those general rules to the durational patterns of the selected speaker in order to cause the synthesizer to mimic that speaker. Such adaptation is accomplished through the valuation of parameters contained in the rules, and this parameter valuation is based on the phoneme duration data derived from the test speech.

Now we reach the crux of the problem addressed by our invention. Because the phoneme durations determined from the test speech are themselves a function of context, the text selection methods available in the art for determining the content and scope of the test sentences require, at best, several thousand observed durations to cover enough contexts for parameter estimation. This large number of observations, and the corresponding large number of sentences which would comprise the test speech, significantly handicaps the estimation of duration parameters for a text-to-speech synthesizer, due to the substantial amount of time required for the recording of the test speech and the huge amount of phoneme data which must be analyzed in such test speech. Additionally, such a large body of test speech renders impossible any reprogramming of such a synthesizer by a user desiring to create a synthesized speech style more in keeping with a speech style familiar to and/or preferred by such a user.

We will show hereafter a system and method for determining test speech sentences which provides an order of magnitude reduction from the prior art in the number of sentences required for reliably estimating the duration parameters. We will also show that, within the constraints of presently known analytic processes, the method of our invention produces the practical minimum number of sentences needed for such estimation of those duration parameters.

SUMMARY OF THE INVENTION

A system and method are provided for selecting units from a corpus of such units based on an analysis of sets of elements corresponding to each such unit with a resultant of an optimum collection of such units. In particular, the invention involves the combination of mapping, via the design matrix, of a feature space to the parameter space of a linear model and applying efficient greedy methods to find a submatrix of full rank, thereby yielding a small set of units containing enough data to estimate the parameters of the model. In a preferred embodiment, the method of the invention is applied to the function of speech synthesis and particularly to the determination of a small set of test sentences (derived, by the process of the invention, from a large corpus of such sentences) that yields sufficient data for estimation of parameters for the duration model of the speech synthesizer. Using a linear model, sets of feature vectors corresponding to the phonetic segments in each sentence of the underlying sentence corpus are mapped into design matrices corresponding to each sentence in that corpus which are related to the parameter space of the chosen model rather than the feature space.

DETAILED DESCRIPTION OF THE INVENTION

Figures 1, 3:
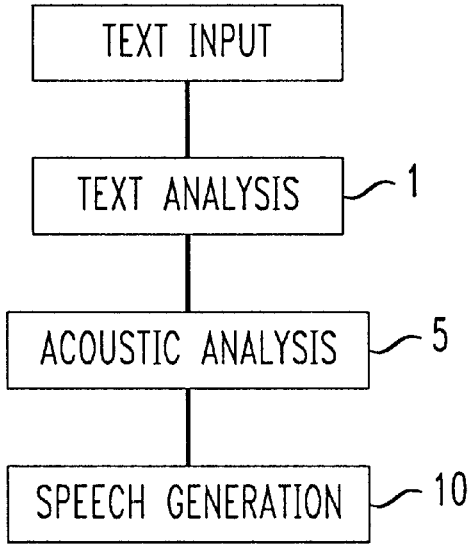
FIG. 1 depicts in functional form the essential elements of a text-to-speech synthesis system.
FIG. 3 depicts a two factor incidence matrix which provides a foundation for the process of the invention.

An essential idea of our invention is the combination of mapping, via a design matrix, the feature space of a domain to the parameter space of a linear model and then applying efficient greedy algorithm methods to the design matrix in order to find a submatrix of full rank, thereby yielding a small set of elements containing enough data to estimate the parameters of the model. We illustrate herein this novel model-based selection methodology through a preferred embodiment of applying that methodology to a determination of an optimal set of test speech for an acoustic module of a text-to-speech synthesis system.

For clarity of explanation, the illustrative embodiment of the present invention is presented as comprising individual functional blocks (including functional blocks labeled as "processors"). The functions these blocks represent may be provided through the use of either shared or dedicated hardware, including, but not limited to, hardware capable of executing software. For example the functions of processors presented in FIG. 2 may be provided by a single shared processor. (Use of the term "processor" should not be construed to refer exclusively to hardware capable of executing software.)

Illustrative embodiments may comprise digital signal processor (DSP) hardware, such as the AT&T DSP16 or DSP32C, read-only memory (ROM) for storing software performing the operations discussed below, and random access memory (RAM) for storing DSP results. Very large scale integration (VLSI) hardware embodiments, as well as custom VLSI circuity in combination with a general purpose DSP circuit, may also be provided.

As a starting point for a description of the preferred embodiment of our invention, consider the following problem of selecting data for training such a TTS system. Given a corpus of data (in the preferred embodiment, a set of sentences), each unit, or sentence, being a collection of elements (such elements representing, in the preferred embodiment, the phonemes corresponding to the sentences), it is desired to model a function mapping elements to values. In the specific case of a TTS system, it is necessary to assign durations, pitch values, etc. to individual phonetic segments. If we start with a model that predicts the desired values associated with phonetic segments based on previous observations, the problem becomes that of selecting a set of sentences from which the observations of desired values associated with the phonetic segments are sufficient to train the model.

As is known, each phonetic segment induces a feature vector representing the set of values corresponding to each speech factor associated with that phonetic segment—e.g., (/c/, word initial, phrase initial, stressed syllable, . . . ). Existing text selection methods employ greedy algorithms to select a set of sentences from a corpus of such sentences to cover the induced feature space. However, as already discussed, the resulting subcorpus of test sentences is relatively large.

In our invention, we choose a linear model for determining duration and other speech values for phonetic segments, and with such a model are able to map the feature vectors for each associated phonetic segment into a design matrix that is related to the parameter space of the model rather than the feature space of the domain. By applying greedy algorithm methods to the design matrix, we are able to achieve a set of test sentences which is substantially smaller than that produced by the prior art method of applying the greedy algorithm to the feature space.

The choice of a model for determining segmental duration parameters is, as discussed in the Background section, largely a function of applying known concepts from a large body of prior research into speech timing and rhythm for the language from which text is to be synthesized. In general the model selection process involves an application of statistical methods to produce equations, or rules, that can predict durations from the contexts in which phonetic segments appear. As such, one skilled in the art of speech synthesis will have no difficulty choosing an appropriate model. Nonetheless, because there are various classes of models which could be chosen, and our methodology is focused on the use of a linear model, we will briefly discuss here the matter of model selection, along with a somewhat more rigorous discussion in the following section.

The use of linear and quasi-linear duration models, and particularly the class of such models described as sums of products models, is discussed at length by co-inventor van Santen in a 1994 article entitled "Assignment of Segmental Duration In Text-To-Speech Synthesis", *Computer Speech and Language,* 8:95–128. Reference is made to that article for a detailed treatment of this subject. Such sums of products models are in use by the previously described AT&T TTS synthesizer system for determination of the durations of phonetic segments. However, because the estimability of sums-of-products model parameters does not have a computationally simple solution, we have focused on the closely related class of analysis-of-variance models where the estimability of parameters can be simply expressed in terms of matrix rank. Data which are sufficient for estimating analysis-of-variance parameters are expected to be sufficient for estimating sums-of-products parameters. Indeed, for the additive and multiplicative variants of the sums-of-products models, this expectation is trivially true.

Having established a duration model, the method of our invention, as applied to speech synthesis, begins with a large corpus of text to assure reasonably complete coverage of the very large number of speech vectors having a major effect on segmental duration. Preferably, this corpus will include at least several hundred thousand sentences, and for ease of data entry, this text corpus should occur as an on-line data base. We have chosen to use as our text corpus approximately the last eight years of the Associated Press Newswire, although many other such on-line data bases could also be used.

Figure 2:
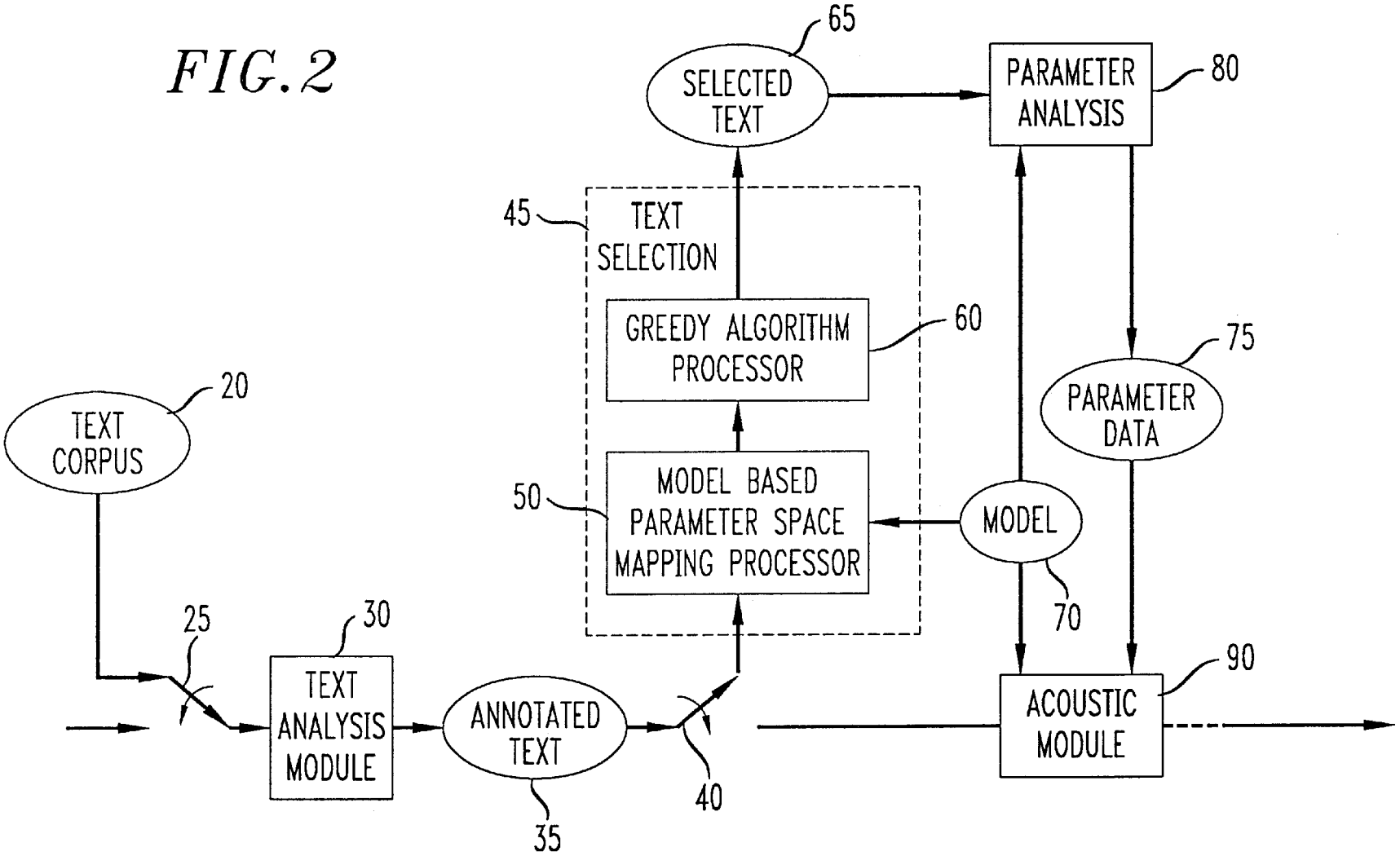
FIG. 2 shows the functional elements of the invention as a subset of the elements of a partially depicted text-to-speech synthesis system.

For a more complete understanding of the operation of the invention, reference is made to FIG. 2 which illustrates the functional elements of the invention as a subset of the elements of a partially depicted text-to-speech synthesis system. As shown in FIG. 2, text corpus 20 is input, via switch 25 (which, along with companion switch 40, enables commonly used TTS functions to be switched between supporting the process of the invention or the TTS process) to Text Analysis module 30, which may be functionally equivalent to the generalized Text Analysis processor 1 of FIG. 1 and having the capabilities previously described for that processor. In the case of the present invention, the function of Text Analysis module 30 is the establishment of a set of feature vectors corresponding to each phonetic segment in each sentence in text corpus 20, along with appropriate annotation of each feature vector in each set to identify the specific sentence from which that set of feature vectors was derived. Thus the output of Text Analysis module 30, Annotated Text 35, will be a set of feature vectors corresponding to each sentence in the text corpus. Those feature vectors may be grouped into sets corresponding to the individual sentences in Text Corpus 20 or to collections of such sentences. Such Annotated Text 35 is then provided, via switch 40, to the input of Text Selection module 45, which, as will be seen from the figure, comprises sub-elements Model-Based Parameter Space Mapping processor 50, and Greedy Algorithm processor 60.

In the operation of Text Selection module 45 each set of sentence-bounded feature vectors will initially be mapped into an incidence matrix by Model-Based Parameter Space Mapping processor 50. An illustrative, but highly simplified incidence matrix for a set of speech vectors depending on only two speech factors (here, vowel and stress), and thus of only two dimensions, is depicted in FIG. 3. As can be seen in the figure, the rows of this exemplary incidence matrix represent various vowel values and the columns represent various stress values. As will be apparent the cells in the matrix represent a stress value and a vowel value corresponding to that position actually occurring in the sentence represented by that matrix.

Using the selected duration model 70, which will have been determined in the manner previously discussed, it becomes a straightforward application of known techniques to transform an incidence matrix defined for a particular sentence into the design matrix corresponding to that incidence matrix. Thus, with an iterative application of that transformation process to each sentence in the text corpus, we arrive at a plurality of design matrices, corresponding to each of the sentences in that text corpus. From there, our object is to find a small number of those design matrices (corresponding to sentences from that text corpus) that, when combined, in the manner of forming the logical union, will be of full rank. (Hereafter we will sometimes use the short-hand term "stacked" to refer to such combined matrices, although it is to be understood that no particular ordering of the combinatorial process—e.g., by row or by column—is implied by the use of such a term.) As is known, a matrix is of full rank if and only if it permits estimation of the parameters of the model. Because of this principle, we can be assured that the sentences represented by our full-rank matrix will be sufficient to estimate the duration parameters for our chosen model.

The process of finding a full-rank design matrix corresponding to a group of sentences which can be used to estimate the duration parameters will be carried out by Greedy Algorithm processor 60, through iterative application of a greedy algorithm to the collection of the design matrices corresponding to the sentences in the text corpus. As will be understood, such a full-rank matrix will ultimately be achieved (if it is possible to reach full rank based on the input data).

Our real concern, however, is that of how "good" is the achieved full-rank matrix—i.e., how many of the design matrices must be combined to form the full-rank matrix (and thus how many sentences are required to reliably estimate the duration parameters) and how much time did the process require to reach a solution. Our goal, of course, is to find the practical minimum number of sentences so required, as well as minimizing the number of iterations by the greedy algorithm (and thus minimize processing time). The first part of this "goodness" criteria—i.e., optimality of the achieved full-rank matrix—is approached as a matroid cover problem. The second part—time to reach a solution—is addressed by application of a modification of the Gram-Schmidt Orthonormalization procedure to the operation of our greedy algorithm.

After each of the sub-functions of Text Selection module 45 have been carried out, a small number of sentences are outputted as Selected Text 65 which represent an optimal set of sentences from Text Corpus 20 for developing the needed parameters associated with Model 70. Such Selected Text is then operated on, along with input from Model 70, by Parameter Analysis module 80, using known analysis methods, to provide Parameter Data 75, for use by Acoustic Module 90, in conjunction with input from Model 70, for predicting the duration of phonemes in text to be synthesized. It will of course be seen that Acoustic Module 90 may also be made a part of the TTS operations path, by operation of Switch 40, to actually determine duration and other acoustic parameters for text to be synthesized by the TTS. In such a TTS mode, an output of the Acoustic Module will provide an input to other downstream TTS functions, including generation of the synthesized speech, corresponding to Speech Generation function 10 in FIG. 1.

Figure 4:
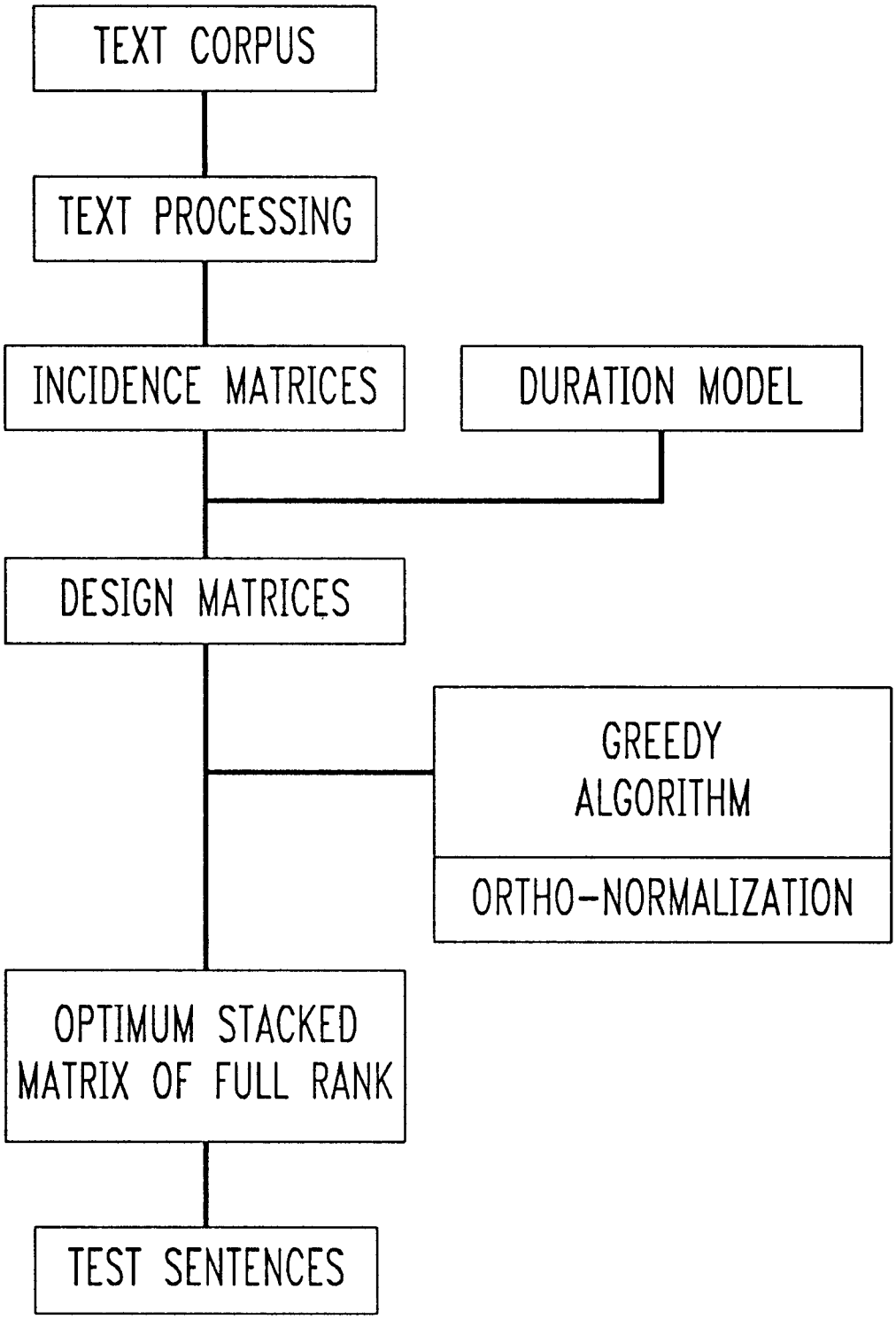
FIG. 4 provides a flow diagram for the operation of the invention.

A flow diagram illustrating the functional elements of the invention is shown in FIG. 4. As can be seen from the figure (and corresponding to the prior discussion) we begin with a corpus of text (100) and operate on that text (Text Processings 105) to produce sets of feature vectors corresponding to each sentence in the text corpus. Those sets of feature vectors are then mapped into a plurality of incidence matrices (110), which are in turn converted to design matrices (115) based on the duration model (120) chosen. A greedy algorithm (125) for finding the matroid cover for this plurality of design matrices and incorporating modified Gram-Schmidt orthonormalization procedure (130) is applied to find an optimum full-rank matrix (135). As can thus be seen, an important aspect of the invention is that of model-based selection, and particularly the application of a greedy algorithm to the parameter space of a linear model, as represented by the plurality of design matrices, to find an optimal submatrix of full rank, thereby yielding a small set of elements (sentences 140) containing enough data to estimate the parameters of the model.

In the following sections we provide a rigorous development of the process of our invention, including background information respecting the general solution of the matroid cover problem and application of the Gram-Schmidt procedure, and conclude with a computer algorithm for applying the method of the invention.

I. DESCRIPTION OF PREFERRED EMBODIMENT

A. Speech Synthesis and Other Background Detail

Each phonetic segment corresponds to a feature vector as follows. There is a set $F=\{1, \ldots, N\}$, for some N, of factors. For each $i \in F$, the factor $F_i$ is a set $\{F_1^i, \ldots, F_{\zeta_i}^i\}$ of $\zeta_i=|F_i|$ distinct features. For example, one factor might be the phonetic segment itself. The features would be the set of possible phonetic segments—in American English, there are about forty (see, e.g., Olive, J. P., Greenwood, A. and Coleman, J. *Acoustics of American English Speech*, Springer-Verlag, New York, 1993). The feature space $\mathcal{F}$ is defined by $\mathcal{F}=F_1 \times \ldots \times F_N$. Each phonetic segment p that must be synthesized corresponds to a feature vector $\vec{f}(p)=(f_1, \ldots, f_N) \in \mathcal{F}$, where $f_i \in F_i$ for $1 \leqq i \leqq N$.

Sums-of-products models and analysis-of-variance models both state that there exists a $K \subseteq 2^F$ such that the duration of a feature vector $(f_1, \ldots, f_N)$ can be predicted by $$D(f_1, \ldots, f_N) = \sum_{I \in K} S_I(f_{I_1}, \ldots, f_{I_{|I|}}) + \mu \tag{1}$$

where for any $I \in K$, $I=\{I_1, \ldots, I_{|I|}\}$; $\mu$ it is some constant.

The two models differ in the constraints on the parameters $S_I$.

(A1) Sums-of-Products Models

As previously noted, the current AT&T Bell Laboratories text-to-speech synthesizer uses a sums-of-products model to predict the duration of each phonetic segment. According to these models $$S_I(f_{I_1}, \ldots, f_{I_{|I|}}) = \prod_{j=1}^{|I|} S_{I,I_j}(f_{I_j}), \quad \forall I \in K \tag{2}$$

In other words, each parameter that depends on multiple factors can be decomposed into a product of parameters, each of which only depends on a single factor.

(A2) Analysis-of-Variance Models

The analysis-of-variance model (see, e.g., Roussas, E. G., *A First Course In Mathematical Statistics*, Addison-Wesley Publishing Company, Reading, Mass., 1973) replaces the multiplicativity assumption in Equation 2 above with the following zero-sum constraint.

$$\sum_{f_{I_j} \in F_{I_j}} S_I(f_I, \ldots, f_{|I|}) = 0, \; 1 \leq j \leq |I|, \; \forall I \in K \tag{3}$$

As an example, let $F=\{1, 2, 3, 4\}$ and $K=\{\{1, 2, 3\}, \{2\}, \{2, 4\}\}$. Then $D(f_1, f_2, f_3, f_4)=S_{\{1, 2, 3\}}(f_1, f_2, f_3)+S_{\{2\}}(f_2)+S_{\{2, 4\}}(f_2, f_4)+\mu$ and $$\sum_{f_1 \in F_1} S_{\{1,2,3\}}(f_1, f_2, f_3) = \sum_{f_2 \in F_2} S_{\{1,2,3\}}(f_1, f_2, f_3) = \sum_{f_3 \in F_3} S_{\{1,2,3\}}(f_1, f_2, f_3) = 0$$

$$\sum_{f_2 \in F_2} S_{\{2\}}(f_2) = 0$$

$$\sum_{f_2 \in F_2} S_{\{2,4\}}(f_2, f_4) = \sum_{f_4 \in F_4} S_{\{2,4\}}(f_2, f_4) = 0$$

The analysis-of-variance model relates directly to the design matrix, which is the input to the matroid cover algorithm. We arrange the parameters of the model in a vector $\rho$ as follows. For some $I \in K$, and without loss of generality, assume that $I=\{1, \ldots, N'\}$ for some $N' \leqq N$. We established above that $\zeta_i=|F_i|$, for $1 \leqq i \leqq N$. We form the subvector $\rho_I$ by compiling the parameters $S_I$ in lexicographic order.

$$(\wp)_I = (S_I(1, \ldots, 1), \ldots, S_I(1, \ldots, \zeta_{N'} - 1); \ldots; \quad (4)$$
$$S_I(1, \ldots, \zeta_{N'-1} - 1, 1), \ldots, S_I(1, \ldots, \zeta_{N'-1} - 1, \zeta_{N'} - 1); \ldots; \ldots;$$
$$S_I(\zeta_I - 1, \ldots, \zeta_{N'-1} - 1, 1), \ldots, S_I(\zeta_1 - 1, \ldots, \zeta_{N'-1} - 1, \zeta_{N'} - 1)).$$

For example, let $I=\{1, 2, 3\}$, $\zeta_1=3$, $\zeta_2=4$, and $\zeta_3=3$. Then $$(\wp)_I = (S_I(1, 1, 1), S_I(1, 1, 2), S_I(1, 2, 1), S_I(1, 2, 2), S_I(1, 3, 1), S_I(1, 3, 2),$$
$$S_I(2, 1, 1), S_I(2, 1, 2), S_I(2, 2, 1), S_I(2, 2, 2), S_I(2, 3, 1), S_I(2, 3, 2)).$$

Finally, ordering the elements of K as $K=\{K_1, \ldots, K_{|K|}\}$, the vector $\wp$ is defined as $$\wp = (\wp)_{K_1} \circ \cdots \circ (\wp)_{K_{|K|}} \circ (\mu) \quad (5)$$

where $\circ$ is vector catenation.[1]/

[1]/$(x_1, \ldots, x_u)\circ(y_1, \ldots, y_v)=(x_1, \ldots, x_u, y_1, \ldots, y_v)$.

Now, consider the feature vector $\vec{f}=(f_1, \ldots, f_N)$. We define a row vector $r(\vec{f})$ as follows. For any $I \in K$, define the subvector $r_I(\vec{f})$ recursively. Again, without loss of generality assume that $I=\{1, \ldots, N'\}$ for some $N' \leqq N$. Let $e_I(\vec{f})$ be the $\Pi_{i=1}^{N'}(\zeta_i-1)$-dimensional vector of all zeros except for a one in the $(f_1, \ldots, f_{N'})$ place in lexicographic order (assuming that $f_i<\zeta_i$, $1 \leqq i \leqq N'$).[2]/

$$r_I(\vec{f}) = e_I(\vec{f}) \quad \text{if } f_i < \zeta_i,\ 1 \le i \le N' \quad (6)$$
$$r_I(\vec{f}) = -\sum_{i=1}^{\zeta_1-1} r_I(i, f_2, \ldots, f_{N'}) \quad \text{if } f_1 = \zeta_1$$
$$\vdots$$
$$r_I(\vec{f}) = -\sum_{i=1}^{\zeta_{N'}-1} r_I(f_1, \ldots, f_{N'-1}, i) \quad \text{if } f_{N'} = \zeta_{N'}$$

[2]/Note that if $f_i=\zeta_i$ for more than one value of i, then Equation 6 is nondeterministic. It is easily proven, however, that any order of application of the possible recurrences will yield the same final answer.

Now, again ordering the elements of K as $K=\{K_1, \ldots K_{|K|}\}$, we define $r_I(\vec{f})=$ as $$r(\vec{f})=r_{K_1}(\vec{f})\circ \ldots \circ r_{K_{|K|}}(\vec{f})\circ(1). \quad (7)$$

Combining Equations 1,3–7 yields $$D(\vec{f}) = r(\vec{f}) \cdot \wp \quad (8)$$

where is the vector scalar product. Equation 8 is the basis for the design matrix, which we next discuss.

(A3) The Design Matrix and Data Selection

The TTS must assign a duration to each phonetic segment to be spoken. Given a phonetic segment p, it is straightforward to construct the corresponding feature vector $\vec{f}(p)$ and the row vector $r(\vec{f}(p))$ as defined in Section A2 above. If the vector $\wp$ is available, then the duration of the phonetic segment is simply $r(\vec{f})\cdot\wp$. The problem in synthesizer construction, therefore, is to determine the vector $\wp$ for the speaker whose voice is being synthesized.

For a sentence $\sigma$ containing $\nu$ phonetic segments $\{p_1, \ldots, p_\nu\}$, let $\vec{D}(\sigma)=\{D(\vec{f}(p_1)), \ldots, D(\vec{f}(p_\nu))\}$ be the column vector of durations of the phonetic segments of $\sigma$. Let $\vec{\wp}$ be the column vector corresponding to vector $\wp$. Let $X(\sigma)$ be the matrix $$\begin{bmatrix} r(\vec{f}(p_1)) \\ \vdots \\ r(\vec{f}(p_\nu)) \end{bmatrix}$$

Equation 8 implies that $$\vec{D}(\sigma) = X(\sigma) \times \vec{\wp} \quad (9)$$

where $\times$ is matrix multiplication.

Given a corpus of s sentences $C=\{\sigma_1, \ldots, \sigma_s\}$, we extend the above definitions in the obvious way. $\vec{D}(C)=\{(\vec{D}(\sigma_1) \circ \ldots \circ \vec{D}(\sigma_s)\}$ is the column vector containing the durations of all the phonetic segments in the corpus. Similarly, X(C) is the matrix $$\begin{bmatrix} X(\sigma_1) \\ \vdots \\ X(\sigma_s) \end{bmatrix}$$

Equation 9 implies that $$\vec{D}(C) = X(C) \times \vec{\wp} \quad (10)$$

We designate X(C) the design matrix of the corpus.

Here we recall that the problem is to find the parameter vector $\wp$. If X(C) is invertible, then Equation 10 implies that $$\vec{\wp} = X(C)^{-1} \times \vec{D}(C). \quad (11)$$

Moreover, if any subset $C' \subseteq C$ of the corpus induces an invertible X(C'), then Equation 11 describes how to recover the parameter vector $\vec{\wp}$ solely from the durations that are observed when the sentences in C' are spoken. In order to reduce the number of sentences that are required to be spoken and observed (for the construction of the synthesizer), it is necessary to find a C' of small cardinality. To formalize that problem, we turn to matroids and matroid covers.

(A4) Matroids

A matroid (see, e.g., Welsh, D. J. A. *Matroid Theory*, Academic Press, 1976) M is a pair $M=(X,\mathcal{M})$, where X is a set of ground elements and $\mathcal{M}\subseteq 2^x$ is a family of subsets of X such that 1. $\emptyset\in\mathcal{M}$;
2. $Y\in\mathcal{M}\Rightarrow Z\in\mathcal{M}$, $\forall Z\subseteq Y$
3. $Y\in\mathcal{M}$, $Z\in\mathcal{M}$, $|Y|>|Z|\Rightarrow\exists x\in Y\backslash Z$ such that $Z\cup\{x\}\in\mathcal{M}$ The sets in $\mathcal{M}$ are called independent sets. For any $S\subseteq X$, we define rank(S) to be the cardinality of the maximal independent set contained in S. For a family $S\subseteq 2^x$ of subsets of X, define rank(S) to be $\text{rank}(\cup_{S\in S}S)$. The rank of M, rank(M), is defined as rank(X). Independent sets of cardinality rank(A) are called bases of M (equivalently bases of $\mathcal{M}$).

Matroids describe some interesting combinatorial structures. For example, given a graph G=(V,E), let $\mathcal{F}$ be the set of all forests over the edge set E. (See, e.g., Tarjan, R. E. *Data Structures and Network Algorithms*, CBMS-NSF Regional Conference Series in Applied Mathematics, Society For Industrial and Applied Mathematics, Philadelphia, Pa., 1983). Then $\mathcal{G}=(E,\mathcal{F})$ is a graphic matroid, the bases of which form the set of all spanning trees of G.

Continuing, for any set X, let $c: X\rightarrow\Re$ be a cost function on the elements of X. Given any $S\subseteq X$, define $c(S)=\Sigma_{x\in S}c(x)$ to be the cost of S. For a matroid M, let $\mathcal{B}(M)$ be a basis of M of minimum cost. For the graphic matroid $\mathcal{G}$, $\mathcal{B}(\mathcal{G})$ is a minimum spanning tree of G.

Matroids are useful, in part because the structures they describe permit efficient searches for minimum cost bases. Let $M=(X,\mathcal{M})$ be any pair, not necessarily a matroid, of ground elements X and family of subsets $\mathcal{M}\subseteq 2^x$ with an associated cost function c. To find a maximum cardinality $B\in\mathcal{M}$ of minimum cost is, for the graphic matroid, equivalent to finding a minimum spanning tree. Since $\mathcal{M}$ can have $2^{|x|}$ members, an exhaustive search is computationally infeasible. It is well known, however, (see, e.g., Welsh, id.) that the greedy algorithm shown in Table 1 computes the correct answer if and only if M is a matroid. The greedy algorithm at each step chooses the ground element of least cost whose addition to the basis-under-construction B, maintains that B as an independent set. For example, the analogous minimum spanning tree algorithm, which at each step chooses the cheapest edge that does not create a cycle, is commonly referred to as Kruskai's Algorithm (as described in Kruskai, J. B. "On The Shortest Spanning Subtree Of A Graph And The Traveling Salesman Problem", *Proceedings of the American Mathematical Society,* 7:53–7, 1956). Further, the greedy algorithm is efficient (i.e., runs in time polynomial in the input size) if an efficient procedure exists that determines membership in $\mathcal{M}$.

TABLE 1

Greedy algorithm for finding a minimum cost basis of a matroid.

```
Let e1 = argmine{c(e)|e ∈ ∪Y∈M Y}.
Let B = {e1}.
```

TABLE 1-continued

Greedy algorithm for finding a minimum cost basis of a matroid.

```
While ∃e ∈ X such that e ∉ B and B ∪ {e} ∈ M do
    Let e' = argmine{c(e)|e ∈ X, e ∉ B, B ∪ {e} ∈ M}.
    Let B = B ∪ {e'}.
done.
```

(A5) Matroid Covers

Given, a matroid $M=(X,\mathcal{M})$, we define the cost function $c:2^x\rightarrow\Re$ to assign costs to sets of ground elements. The cost of a family $S\subseteq 2^x$ of sets is $c(S)=\Sigma_{Y\in S}c(Y)$. A family of sets $S\subseteq 2^x$ such that rank(S)=rank(M) is said to be a matroid cover (or simply a cover) of M (and $\mathcal{M}$). The matroid cover problem, given a matroid $M=(X,\mathcal{M})$ and cost function $c:2^x\rightarrow\Re$, is to find a cover of M of minimum cost.

If we let X be the set of all vectors in $\Re^m$, for some m, and $\mathcal{M}$ be the family of subsets of X of linearly independent vectors, then $M=(X,\mathcal{M})$ is clearly a matroid (sometimes referred to as the linear matroid). Now, consider the design matrix X(C) of Section A3, and particularly the component matrices $X(C_1),\ldots,X(C_s)$ formed from each sentence in the corpus C. Each $X(C_i)$, for some $1\leqq i\leqq s$, is a collection of vectors in $\Re^m$, where $m=|\mathcal{O}|$. If we assign $c(X(C_i))=1$, for each $1\leqq i\leqq s$, and $c(Y)=s+1$ for each other $Y\in 2^x$, then finding the minimum cost matroid cover for matroid M returns a subcorpus $C'\subseteq C$ such that C' is of minimum cardinality among all such C' that induce an invertible X(C'), assuming that such a C' exists.

In the next section, we describe the performance of the greedy algorithm in finding such a minimum cost matroid cover.

B Greedy Algorithms for Matroid Covers

The greedy algorithm for the matroid cover problem, as it relates to selecting the minimum cardinality subcorpus as described in Section A5, operates analogously to the greedy algorithm for finding the least cost basis of a matroid and at each step chooses the $X(C_i)$ whose inclusion in the matroid cover being constructed results in the maximal increase in rank of that cover. We provide a formal description of that algorithm in Table 2. The algorithm terminates upon (1) finding a matroid cover, or (2) determining that X(C) itself is not invertible.

TABLE 2

Greedy algorithm for approximating a minimum cardinality matroid cover

```
Let B = ∅
While ∃Ci ∈ C such that rank(B ∪ {Ci}) > rank(B) do
    Let B' = argmaxCi {rank(B ∪ {Ci})}
    Let B = B ∪ {B'}.
done.
```

(B1) Optimality

Here we describe the optimality of the cover B returned by the greedy algorithm by comparing its cardinality to that of the optimal solution $\mathcal{B}$. Nemhauser and Wolsey (Integer and Combinatorial Optimization, John Wiley & Sons, 1988) show that for the problem of minimizing a linear function (e.g., the cost function above) subject to a submodular constraint (e.g., matroid rank), the greedy algorithm approximates the solution to within a logarithmic factor of the optimal. In particular, their result extends to prove that the greedy algorithm returns a matroid cover B such that $|B| \leqq H_m$ 6. $H_m = \Sigma_{i=1}^{m} 1/i$ is the m'th harmonic number, and it is well known (see, e.g., Greene, D. R. and Knuth, D. E. *Mathematics for the Analysis of Algorithms*, Birkhauser, Boston, second edition, 1982) that $H_m = \theta(1n\ m)$. Thus, the greedy algorithm returns a matroid cover with cardinality within a logarithmic factor of that of the optimal cover. We will show below that this is computationally the best solution which can be found within the constraints of known analytic processes.

Consider now the set cover problem, described fully by Garey, M. R. and Johnson, D. S. *Computers and Intractability: A Guide To The Theory Of NP-Completeness*, W. H. Freeman and Company, New York, 1979. Given is a set X, a family $C \subseteq 2^x$ of subsets of X, and a positive integer $K \leqq |C|$. The related decision problem is: Is there a subset $C' \subseteq C$ with $|C'| \leqq K$ such that $\cup_{Y \in C'} Y = X$? This problem is NP-complete. The related optimization problem—find a C' of minimum cardinality that covers X—is NP-hard. Furthermore, Lund and Yannakakis ("On the Hardness of Approximating Minimization Problems" (extended abstract), In *Proc.* 25th *ACM Symp. on Theory of Computing*, pages 286–293, 1993) prove that no algorithm can, for all instances, return a covering set C" such that $|C''| \leqq (1/4 \log |X|)|C'|$ unless NP is contained in DTIME $[n^{poly\ log\ n}]$.

It is straightforward to reduce an instance of set cover to an instance of the minimum cardinality linear matroid cover problem so that an approximation to the latter yields a similar approximation to the former. Let the set X be $X = \{1, \ldots, m\}$. Let $C \subseteq 2^x$ as above. For each element $x \in X$, define $M(x) = e(x)$, where e(x) is the m-dimensional vector of all zeros except for a one in the x'th place. Let $M(Y) = \{M(x) | x \in Y\}$ for any $Y \subseteq X$. Let $M = \mathfrak{R}^m, \mathcal{M})$ (where $\mathcal{M}$, as before, is the family of sets of linearly independent vectors in $\mathfrak{R}^m$) be the linear matroid. The cost function c assigns $$c(Y)=1 \text{ if } Y=M(Z) \text{ for some } Z \in C.$$

$$c(Y)=m+1 \text{ if } Y \neq M(Z) \text{ for every } Z \in C.$$

It is easily shown that a set cover $C' \subseteq C$ induces a matroid cover B, and vice-versa, such that $|C'| = |B|$. The cost function c assures us that for any $Y \in B$, we have $Y = M(Z)$ for some $Z \in C$. Therefore, we cannot hope to do better (up to constant factors) than to approximate the linear matroid cover to within a logarithmic factor of the optimal solution, unless unlikely collapses of complexity classes occur.

(B2) Time Complexity

We are concerned with not only how well the greedy algorithm of Table 2 achieves a minimal cardinality for the matroid cover, we are also interested in how long the algorithm takes to compute the approximation. The answer depends upon the implementation. We will consider first a naive implementation. We then describe a better approach that dramatically reduces the computational complexity. Let there be s sets $\{X_1, \ldots, X_s\}$ of vectors over $\mathfrak{R}^m$. Let $n_i = |X_i|$ for $1 \leqq i \leqq s$, and let $n = \Sigma_{i=1}^{s} n_i$ be the total number of vectors.

The naive method first computes that the rank of each set $X_i$ of vectors. It assigns B to contain the set of maximal rank. During each phase, it computes the rank of $B \cup \{X_i\}$ for each $1 \leqq i \leqq s$ and updates B to be $B \cup \{X_i\}$ for an $X_i$ that incurs the most increase in rank. The algorithm terminates once B is of rank m or no $X_i$ can increase the rank of B.

Assume that $n_i = m/2$ for $1 \leqq i \leqq s$. This implies that each phase requires $\theta(\Sigma_{i=1}^{s} n_i^2) = \theta(m \Sigma_{i=1}^{s} n_i) = \theta(nm)$ vector operations. Assume further that for any $1 \leqq i < j \leqq s$, $\text{rank}(X_i \cup X_j) = m/2+1$. This implies that there must be $\Omega(m/2)$ phases, and thus the total number of vector operations is $\Omega(nm^2)$. The time complexity, therefore, is $\Omega(nm^3)$.

In the following sections, we describe a more incremental procedure that does better by a factor of m. We also show why, for the greedy approach, this is the best possible time bound.

C Gram-Schmidt Orthonormalization

In this section we provide an overview of the Gram-Schmidt orthonormalization procedure, which provides a foundation for our incremental greedy linear matroid cover algorithm described in the next section. Given a set $X = \{x_1, \ldots, x_n\}$ of linearly independent vectors over $\mathfrak{R}^m$, the (Gram-Schmidt procedure produces a set $Y = \{y_1, \ldots, y_n\}$ of mutually othogonal vectors such that span(X)=span(Y). The procedure is as follows: (For more detailed discussion, see, e.g., Golub, G. H. and van Loan, C. F. *Matrix Computations*, Johns Hopkins Series in the Mathematical Sciences, Johns Hopkins University Press, Baltimore, second edition, 1989, or Barnett, S. *Matrices, Methods and Applications*, Oxford Applied Mathematics and Computing Science Series, Clarendon Press, Oxford, 1990)

$$y_i = x_i = \sum_{j=1}^{i-1} \frac{x_i \cdot y_j}{y_j \cdot y_j} y_j, \quad 1 \leq i \leq n$$

The procedure can easily be modified to produce mutually orthonormal vectors $y_i$ as follows. Let $\|x\| = (x \cdot x)^{1/2}$.

$$y_i = \frac{z_i}{\|z_i\|}, \quad 1 \leq i \leq n$$

$$z_i = x_i - \sum_{j=1}^{i-1} (x_i \cdot y_j) y_j, \quad 1 \leq i \leq n$$

With care, we can dispense with the precondition that the $x_i$ are linearly independent. Let i be minimal such that $x_i$ is linearly dependent on $x_1, \ldots, x_{i-1}$. In this case, the Gram-Schmidt procedure produces $y_i = \vec{0}$, where $\vec{0}$ is the m-dimensional vector of all zeros. For the orthonormal variant of the Gram-Schmidt procedure, we need only modify the $y_i = z_i/(\|z_i\|)$ part to be instead $$y_i = \frac{z_i}{\|z_i\|} \text{ if } z_i \neq \vec{0}$$

$$y_i = z_i \text{ if } z_i = \vec{0}$$

We use the Gram-Schmidt procedure to implement an incremental greedy linear matroid over algorithm. The idea is to construct a basis B and maintain the invariants such that the sets $X_i$ of vectors are orthonormal to the basis at all times. As new vectors are added to B, we need only orthonormalize the non-zero vectors remaining in the $X_i$ with the vectors that were just added to B. In this way, we reduce the number of vector operations over the life of the algorithm by a factor of m.

(C1) Modified Gram-Schmidt Procedure

The Gram-Schmidt procedure described in the preceding section has poor numerical properties. (See, e.g., Golub and van Loan, id.) The following modified Gram-Schmidt procedure has better numerical properties and produces the same results in the same computational time as does the Gram-Schmidt procedure.

Rather than subtract from each vector $x_i$ the sum of the non-orthogonal components of the preceding vectors, we subtract these linear dependencies iteratively to produce the vectors $y_i$.

$$y_i = \frac{z_i}{\|z_i\|}, \quad 1 \le 1 \le n$$

$$z_i, = z_i^{i-1}, \quad 1 \le i \le n$$

$$z_i^0 = x_i, \quad 1 \le i \le n$$

$$z_i^j = z_i^{j-1} - (z_i^{j-1} \cdot y_j) y_j, \quad 1 \le j < i \le n$$

We can make the same modification as above to allow the input vectors $x_i$ to have linear dependencies.

We have implemented the algorithm described in the next section using this modified Gram-Schmidt procedure. To simplify the description of the algorithm, however, we actually describe it in terms of the Gram-Schmidt procedure of Section C. The results are just as valid, and it is easily shown that the Gram-Schmidt and modified Gram-Schmidt procedures employ the same number of vector operations; therefore, the time bounds are legitimate as stated.

D Incremental Greedy Algorithm for Matroid Covers

The naive greedy linear matroid cover algorithm described in Section B2 suffers from the flaw that it computes the ranks of matrices in full during each phase, whereas the matrices change only gradually throughout the life of the algorithm. Here we employ the Gram-Schmidt procedure to maintain the sets of vectors so that we can judiciously orthonormalize vectors against only those pertinent vectors that have changed since the last iteration.

We begin with some definitions. As input we have a collection $C=(X_1, \ldots, X_s)$ of subsets of vectors from the linear matroid $M=(\Re^m, \mathcal{M})$. Let $r_i=|X_i|$, for $1 \leqq i \leqq s$. We compute from C a cover[3]/ B of M incrementally. The algorithm progresses in phases. Let $x_i^p$ be the set of vectors corresponding to $X_i$ after phase p, for $1 \leqq i \leqq s$. We denote by $r_i^p$ the cardinality of $x_i^p$; initially p=0. Similarly, let $B^p$ be the cover-in-progress after phase p, and let $r_B^p=|B^p|$; initially, $B^o=\emptyset$. Let $n^p=\Sigma_{i=1}^s r_i^p$, the total number of vectors after phase p; $n=\Sigma_{i=1}^s r_i$ is the total number of vectors in the input. Finally, we denote by $b_i$ the i'th vector in B.

[3]/Technically, the B that the algorithm computes is the union of the sets in the cover.

We maintain the following invariants.

1. The vectors in each $x_i^p$, for all p and $1 \leqq i \leqq s$, are mutually orthonormal.

2. The vectors in $B^p$ for all p are mutually orthonormal.

3. The vectors in each $x_i^p$, for $1 \leqq i \leqq s$, are mutually orthonormal with the vectors in $B^p$, for all p.

We will address the fact that the input might not satisfy invariant (1) below. Assuming that the invariants hold after phase p−1, phase p of the algorithm proceeds as shown in Table 3. The algorithm terminates once $r_B^p=m$ for some p, or when $r_i^p=0$ for some p and $1 \leqq i \leqq s$.

At this point we turn to a discussion of the correctness of the algorithm. Invariant (1) guarantees us that $\text{rank}(X_i^p)=r_i^p$ for all p and $1 \leqq i \leqq s$. Similarly, invariant (2) guarantees us that $\text{rank}(B^p)=r_B^p$ for all p. Invariant (3) guarantees us that the choice of V in line 1 is correct; that is, V is such that rank $(B^{p-1} \cup V)$ is maximal. Invariant (3) also guarantees us that setting $B^p$ to $B^{p-1} \cup V$ in line 2 increases the rank of B by $|V|$ and that variant (2) is satisfied after each phase p.

TABLE 3

Pseudocode for phase p of the incremental greedy linear matroid cover algorithm.

1. Let $V = X_1^{p-1}$ such that $r_1^{p-1} = \max_j\{r_j^{p-1}\}$.
2. Let $B^p = B^{p-1} \cup V$
3. Let $r_B^p = r_B^{p-1} + |V|$.
4. For $1 \leqq i \leqq s$, consider the vectors of $X_i^{p-1}$. Call them $x_1^{p-1}, \ldots, x_{r_i^{p-1}}^{p-1}$.
5. For $1 \leqq j \leqq r_i^{p-1}$ do
6. $$\text{Let } z_j = x_j^{p-1} - \sum_{k=r_B^{p-1}+1}^{r_B^p} (x_j^{p-1} \cdot b_k) b_k - \sum_{k=1}^{j-1} (x_j^{p-1} \cdot x_k^p) x_k^p.$$
7. $$\text{If } z_j \neq \vec{0} \text{ then let } x_j^p = \frac{z_j}{\|z_j\|}.$$
8. Else let $x_j^p = z_j$
9. end For
10. Let $X_i^p = \{x_j^p, 1 \leqq j \leqq r_i^{p-1} | x_j^p \neq \vec{0}\}$.
11. Let $r_i^p = |X_i^p|$.
12. end For The remainder of the work in phase p is to restore invariants (1) and (3). Consider line 6 of the algorithm. The goal is to orthonormalize each vector $x_j^{p-1}$ in the set $X_i^{p-1}$ with the vectors in B and the preceding vectors in $X_i^{p-1}$. To do this, we should set $$z_j = x_j^{p-1} - \sum_{k=1}^{r_B^p} (x_j^{p-1} \cdot b_k) b_k - \sum_{k=1}^{j-1} (x_j^{p-1} \cdot x_k^p) x_k^p.$$

Invariant (3), however, guarantees us that $(x_j^{p-1} \cdot b_k)=0$ for $1 \leqq k \leqq r_B^{p-1}$. This allows us to eliminate the corresponding vector operations, and this is where we save computational time. From the discussion of the Gram-Schmidt procedures in Section C, it is clear that we have restored the invariants at completion of each phase p.

All that is left to address in terms of correctness is that the invariants are true at the beginning of the algorithm. To do this, we run an initialization phase—this is phase 0—to orthonormalize the vectors in each $X_i$, producing the sets $X_i^0$ for $1 \leqq i \leqq s$, using the Gram-Schmidt: procedure. Thus at the end of phase 0, the invariants are satisfied.

As a final note, the algorithm as described must be modified slightly to maintain a record of which $X_i$ were used to form the cover B. This modification is straightforward and omitted for clarity.

(D1) Time Complexity

Here, we determine the running time of the algorithm presented in the preceding section. We will assume for purposes of this analysis that the algorithm runs for θ phases before completion. Consider the time taken by some phase p>0. The selection of V in line 1 requires O(s) time. The update to B in line 2 requires $r_B^p - r_B^{p-1}$, vector operations (assignments), each of which takes O(m) time. Line 3 takes unit time.

The time for the rest of phase p is clearly dominated by the inner loop, and particularly, the computation in line 6. In that step of the algorithm, each vector in $X_i^{p-1}$ is orthonormalized against the $r_B^p - r_B^{p-1}$ vectors that have just been added to B as well as the vectors that precede it in the set. The number of vector operations in the loop for phase p, therefore, is dominated by $$\phi(p) = \sum_{i=1}^{s} r_i^{p-1}\left(r_B^p - r_B^{p-1} + r_i^{p-1} - 1\right). \tag{12}$$

The choice of V in line 1 ensures that for any p>0 and $1 \leqq i \leqq s$, $r_i^{p-1} \leqq r_B^p - r_B^{p-1}$, so we can rewrite Equation 12 to read $$\begin{aligned}\phi(p) &\leq \left(2\left(r_B^p - r_B^{p-1}\right) - 1\right)\sum_{i=1}^{s} r_i^{p-1} \\ &= \left(2\left(r_B^p - r_B^{p-1}\right) - 1\right)n^{p-1} \\ &\leq \left(2\left(r_B^p - r_B^{p-1}\right) - 1\right)n\end{aligned} \tag{13}$$

The time spent in the loop of each phase p>0 clearly dominates the time spent in the preamble of the phase. Therefore, we use Equation 13 to bound the number of vector operations $\phi_1^\theta$ incurred during phases 1 through θ.

$$\begin{aligned}\phi_1^\theta &= O\left(\sum_{p=1}^{\theta} \phi(p)\right) \\ &= O\left(\sum_{p=1}^{\theta} \left(2\left(r_B^p - r_B^{p-1}\right) - 1\right)n\right) \\ &= O(n(r_B^\theta - r_B^O)) \\ &= O(nm).\end{aligned}$$

The time spent by the algorithm in phases 1 through θ, therefore, is $O(m\phi_1^\theta) = O(nm^2)$.

The number of vector operations in phase 0—to orthonormalize the input sets $X_i$—is $\Sigma_{i=1}^{s}(n_i)^2$. Therefore, the running time of the incremental greedy linear matroid cover algorithm of Section D is $O(nm^2 + m\Sigma_{i=1}^{s}(n_i)^2$.

Bounding the $n_i$ might simplify the asymptotic time complexity of our algorithm. When we use matroid covers to model the problem of selecting sentences from a corpus to be uttered for estimation of duration parameters, we typically have values of m ranging between 100 and 1000. It is reasonable to assume that the sentences in the corpora have under 100 phonetic segments each. Since each phonetic segment induces a vector in an input set corresponding to a sentence, this leads to the assumption that $n_i \leqq m$ for $1 \leqq i \leqq s$. Under this assumption, the running time of the algorithm is $O(nm^2)$. Furthermore, for a given natural language, the feature space and thus m will be fixed; therefore, running over different corpora for a given natural language, the time is linear in the number of phonetic segments in the corpora.

Finally, we consider lower bounds on the time of the greedy approach. Any deterministic greedy algorithm must establish the rank of each initial set, which requires $\Omega(\Sigma_{i=1}^{s}(n_i)^2)$ vector operations. Therefore, our algorithm is optimal, with respect to time complexity, among the class of deterministic greedy algorithms for linear matroid covers.

Conclusion

Herein we have disclosed an important new system and process for the selection of an optimum set of units—in a preferred embodiment: sentences—from a corpus of data, based on a model chosen to fit that data. In particular the process of our invention applies a greedy algorithm to the parameter space of a linear model, as represented by a plurality of design matrices, to find an optimal submatrix of full rank, thereby yielding a small set of elements containing enough data to estimate the parameters of the model.

Although the process of the invention has been described in terms of a preferred embodiment for text-to-speech synthesis, and particularly the selection of a small number of test sentences which will be sufficient for estimating the phoneme duration parameters required by the duration model of such a synthesizer, we believe that the invention will be applicable to a variety of parameter estimation circumstances where an object is to realize an optimum subset of data from a large corpus of data.

Although the present embodiment of the invention has been described in detail, it should be understood that various changes, alterations and substitutions can be made therein without departing from the spirit and scope of the invention as defined by the appended claims.

We claim the following:

1. A method for identifying a subset of a corpus of speech data usable for estimating speech parameters in a speech processing application, said corpus being arranged as a plurality of sentences, comprising the steps of:

constructing feature vectors corresponding to all phonetic segments appearing in said corpus;

mapping said feature vectors into a plurality of matrices based on a model chosen to fit said corpus, said matrices being arranged to include sets of said feature vectors corresponding to sentences in said corpus; and operating on said parameter space matrices with a greedy algorithm to find a submatrix of full rank, said full-rank submatrix being formed by the union of one or more of said model-based matrices and whereby sentences corresponding to said one or more of said model-based matrices included in said full-rank submatrix comprise said subset of said corpus of speech data;

wherein an articulation of one or more of said corresponding sentences provides an input to said speech processing application for estimation of said speech parameters.

2. The speech parameter estimation method of claim 1 wherein duration parameters for a plurality of phonetic segments are estimated.

3. The speech parameter estimation method of claim 1 wherein said model chosen to fit said corpus is a linear model.

4. The speech parameter estimation method of claim 1 wherein said greedy algorithm includes orthonormalization of said speech feature vectors.

5. The speech parameter estimation method of claim 4 wherein said greedy algorithm is of the form Let $V = X_i^{p-1}$ such that $r_i^{p-1} = \max_j\{r_j^{p-1}\}$ -continued Let $B^p = B^{p-1} \cup V$ Let $r_B^p = r_B^{p-1} + |V|$ For $1 \le i \le s$, consider the vectors of $x_i^{p-1}$. Call them $x_1^{p-1}, \ldots, x_{r_i^{p-1}}^{p-1}$ For $1 \le j \le r_i^{p-1}$ do Let $z_j = x_j^{p-1} - \sum_{k=r_B^{p-1}+1}^{r_B^p} (x_j^{p-1} \cdot b_k) b_k - \sum_{k=1}^{j-1} (x_j^{p-1} \cdot x_k^p) x_k^p$ If $z_j \neq \vec{0}$ then let $x_j^p = \frac{z_j}{\|z_j\|}$ Else let $x_j^p = z_j$ end For Let $X_i^p = \{x_j^p, 1 \le j \le r_i^{p-1} | x_j^p \neq \vec{0}\}$ Let $r_i^p = |X_i^p|$ end For.

6. A system for identifying a subset of a corpus of speech data usable for estimating speech parameters in a speech processing application, said corpus being arranged as a plurality of sentences, comprising:

means for constructing feature vectors corresponding to all phonetic segments appearing in said corpus;

means for mapping said feature vectors into a plurality of matrices based on a model selected to fit said corpus, said matrices being arranged to include sets of said feature vectors corresponding to sentences in said corpus; and means for applying a greedy algorithm to said model-based matrices for finding a submatrix of full rank, said full-rank submatrix being formed by the union of one or more of said model-based matrices and whereby sentences corresponding to said one or more of said model-based matrices included in said full-rank submatrix comprise said subset of said corpus of speech data;

wherein an articulation of one or more of said corresponding sentences provides an input to said speech processing application for estimation of said speech parameters.

7. The speech parameter estimation system of claim 6 wherein said greedy algorithm includes orthonormalization of said feature vectors.

8. The speech parameter estimation system of claim 7 wherein said greedy algorithm is of the form Let $V = X_i^{p-1}$ such that $r_i^{p-1} = \max_j \{r_j^{p-1}\}$ Let $B^p = B^{p-1} \cup V$ Let $r_B^p = r_B^{p-1} + |V|$ For $1 \le i \le s$, consider the vectors of $x_i^{p-1}$. Call them $x_1^{p-1}, \ldots, x_{r_i^{p-1}}^{p-1}$ For $1 \le j \le r_i^{p-1}$ do Let $z_j = x_j^{p-1} - \sum_{k=r_B^{p-1}+1}^{r_B^p} (x_j^{p-1} \cdot b_k) b_k - \sum_{k=1}^{j-1} (x_j^{p-1} \cdot x_k^p) x_k^p$ If $z_j \neq \vec{0}$ then let $x_j^p = \frac{z_j}{\|z_j\|}$ Else let $x_j^p = z_j$ end For Let $X_i^p = \{x_j^p, 1 \le j \le r_i^{p-1} | x_j^p \neq \vec{0}\}$ Let $r_i^p = |X_i^p|$ end For.

9. In a method for synthesizing speech from text comprising the steps of:

analyzing input text to determine phonetic segments for said input text;

estimating acoustic parameters associated with each said phonetic segment; and generating a speech waveform based on said estimated acoustic parameters to synthesize said input text into speech;

wherein said acoustic parameters determined in said estimating step are derived from a set of training data, and said training data are manifested as a set of sentences selected from a corpus of speech data arranged as a plurality of sentences;

a method for selecting said selected sentences comprising the steps of:

constructing feature vectors corresponding to all phonetic segments appearing in said corpus;

mapping said feature vectors into a plurality of matrices based on a model chosen to fit said corpus, said matrices arranged to include sets of said feature vectors corresponding to sentences in said corpus; and operating on said model-based matrices with a greedy algorithm to find a submatrix of full rank, said full-rank submatrix being formed as the union of one or more of said model-based matrices, whereby sentences corresponding to said one or more of said model-based matrices included in said full-rank submatrix comprise said selected sentences.

10. The text-to-speech synthesis method of claim 9 wherein said estimated acoustic parameters include duration parameters for a plurality of phonetic segments.

11. The text-to-speech synthesis method of claim 9 wherein said chosen model is a linear model.

12. The text-to-speech synthesis method of claim 9 wherein said greedy algorithm includes orthonormalization of said feature vectors.

13. The text-to-speech synthesis method of claim 12 wherein said greedy algorithm is of the form Let $V = X_i^{p-1}$ such that $r_i^{p-1} = \max_j \{r_j^{p-1}\}$ Let $B^p = B^{p-1} \cup V$ Let $r_B^p = r_B^{p-1} + |V|$ For $1 \le i \le s$, consider the vectors of $x_i^{p-1}$. Call them $x_1^{p-1}, \ldots, x_{r_i^{p-1}}^{p-1}$ For $1 \le j \le r_i^{p-1}$ do -continued Let $z_j = x_j^{p-1} - \sum_{k=r_B^{p-1}+1}^{r_B^p} (x_j^{p-1} \cdot b_k) b_k - \sum_{k=1}^{j-1} (x_j^{p-1} \cdot x_k^p) x_k^p$ If $z_j \neq \vec{0}$ then let $x_j^p = \frac{z_j}{\|z_j\|}$ Else let $x_j^p = z_j$ end For Let $X_i^p = \{x_j^p, 1 \leq j \leq r_i^{p-1} | x_j^p \neq \vec{0}\}$ Let $r_i^p = |X_i^p|$ end For.

14. In a system for synthesizing speech from text comprising:

a text analysis means for analyzing input text to determine phonetic segments for said input text;

parameter estimation means for estimating acoustic parameters associated with each said phonetic segment; and speech generation means for generating a speech waveform based on said estimated speech parameters to thereby synthesize said input text into speech; wherein said parameter estimation means further includes means for deriving a set of training data, said training data being manifested as a set of sentences selected from a corpus of speech data arranged as a plurality of sentences, and said means for deriving a set of training data further comprises:

means for constructing feature vectors corresponding to all phonetic segments appearing in a plurality of sentences;

means for mapping said feature vectors into a plurality of matrices based on a model chosen to fit said plurality of sentences, said matrices being arranged to include sets of said feature vectors corresponding to sentences in said plurality of sentences;

means for applying a greedy algorithm to said model-based matrices for finding a submatrix of full rank, said full-rank submatrix being formed as the union of one or more of said model-based matrices.

15. The text-to-speech synthesis system of claim 14 wherein said greedy algorithm includes orthonormalization of said feature vectors.

16. The text-to-speech synthesis system of claim 14 wherein said greedy algorithm is of the form Let $V = X_i^{p-1}$ such that $r_i^{p-1} = \max_j \{r_j^{p-1}\}$ Let $B^p = B^{p-1} \cup V$ Let $r_B^p = r_B^{p-1} + |V|$ For $1 \leq i \leq s$, consider the vectors of $x_i^{p-1}$. Call them $x_1^{p-1}, \ldots, x_{r_i^{p-1}}^{p-1}$ For $1 \leq j \leq r_i^{p-1}$ do Let $z_j = x_j^{p-1} - \sum_{k=r_B^{p-1}+1}^{r_B^p} (x_j^{p-1} \cdot b_k) b_k - \sum_{k=1}^{j-1} (x_j^{p-1} \cdot x_k^p) x_k^p$ -continued If $z_j \neq \vec{0}$ then let $x_j^p = \frac{z_j}{\|z_j\|}$ Else let $x_j^p = z_j$ end For Let $X_i^p = \{x_j^p, 1 \leq j \leq r_i^{p-1} | x_j^p \neq \vec{0}\}$ Let $r_i^p = |X_i^p|$ end For.

17. A method for selecting speech parameter estimation sentences to be applied in a speech processing application by analyzing each of a plurality of sentences, said plurality of sentences including said selected speech parameter estimation sentences, according to the following steps:

constructing feature vectors corresponding to all phonetic segments appearing in said plurality of sentences;

mapping said feature vectors into a plurality of matrices based on a model chosen to fit said plurality of sentences, said matrices being arranged to include sets of said feature vectors corresponding to sentences in said plurality of sentences; and operating on said model-based matrices with a greedy alogorithm to find a submatrix of full rank, said full-rank submatrix being formed by the union of one or more of said model-based matrices, the sentences corresponding to said one or more of said model-based matrices comprising said full-rank submatrix being selected as said speech parameter estimation sentences;

wherein an articulation of one or more of said speech parameter estimation sentences provides an input to said speech processing application for estimation of said speech parameters.

18. The speech parameter estimation sentence selection method of claim 17 wherein said estimation sentences enable the prediction of duration parameters for a plurality of phonetic segments.

19. The speech parameter estimation sentence selection method of claim 17 wherein said model chosen to fit said plurality of sentences is a linear model.

20. The speech parameter estimation sentence selection method of claim 17 wherein said greedy algorithm includes orthonormalization of said feature vectors.

21. The speech parameter estimation sentence selection method of claim 20 wherein said greedy algorithm is of the form Let $V = X_i^{p-1}$ such that $r_i^{p-1} = \max_j \{r_j^{p-1}\}$ Let $B^p = B^{p-1} \cup V$ Let $r_B^p = r_B^{p-1} + |V|$ For $1 \leq i \leq s$, consider the vectors of $x_i^{p-1}$. Call them $x_1^{p-1}, \ldots, x_{r_i^{p-1}}^{p-1}$ For $1 \leq j \leq r_i^{p-1}$ do Let $z_j = x_j^{p-1} - \sum_{k=r_B^{p-1}+1}^{r_B^p} (x_j^{p-1} \cdot b_k) b_k - \sum_{k=1}^{j-1} (x_j^{p-1} \cdot x_k^p) x_k^p$ If $z_j \neq \vec{0}$ then let $x_j^p = \frac{z_j}{\|z_j\|}$ -continued Else let $x_j^p = z_j$ end For Let $X_i^p = \{x_j^p, 1 \le j \le r_i^{p-1} | x_j^p \ne \vec{0}\}$ Let $r_i^p = |X_i^p|$ end For.

22. A set of test sentences for estimation of speech parameters selected according to the method of claim 17.

23. A model for estimation of speech parameters characterized as being populated in accordance with data derived from speech parameter estimation sentences selected according to the method of claim 17.

24. A storage means fabricated to contain a set of speech parameter estimation sentences selected in accordance with the method of claim 17.

25. A storage means fabricated to contain a model for estimation of speech parameters, said model characterized as being populated in accordance with data derived from speech parameter estimation sentences selected according to the method of claim 17.

26. A method for estimating speech parameters in a speech processing application by use of a model populated from data derived from a selected set of speech parameter estimation sentences, said speech parameter estimation sentences having been selected according to the following steps:

constructing feature vectors corresponding to all phonetic segments appearing in a plurality of sentences, said plurality of sentences including said selected speech parameter estimation sentences;

mapping said feature vectors into a plurality of matrices based on said model, said matrices being arranged to include sets of said feature vectors corresponding to sentences in said plurality of sentences; and operating on said model-based matrices with a greedy algorithm to find a submatrix of full rank, said full-rank submatrix being formed by the union of one or more of said model-based matrices, the sentences corresponding to said one or more of said model-based matrices comprising said full-rank submatrix being selected as said speech parameter estimation sentences;

wherein an articulation of one or more of said speech parameter estimation sentences provides an input to said speech-parameter-estimation model.

27. The method for estimating speech parameters of claim 26 wherein said selection of said speech parameter estimation sentences estimation sentences is further characterized by said model being a linear model.

28. The method for estimating speech parameters of claim 26 wherein said selection of said speech parameter estimation sentences estimation sentences is further characterized by said greedy algorithm including orthonormalization of said feature vectors.

29. The method for estimating speech parameters of claim 28 wherein said selection of said speech parameter estimation sentences estimation sentences is further characterized by said greedy algorithm being of the form Let $V = X_i^{p-1}$ such that $r_i^{p-1} = \max_j \{r_j^{p-1}\}$ Let $B^p = B^{p-1} \cup V$ Let $r_B^p = r_B^{p-1} + |V|$ For $1 \le i \le s$, consider the vectors of $x_i^{p-1}$. Call them $x_1^{p-1}, \ldots, x_{r_i^{p-1}}^{p-1}$ For $1 \le j \le r_i^{p-1}$ do Let $z_j = x_j^{p-1} - \sum_{k=r_B^{p-1}+1}^{r_B^p} (x_j^{p-1} \cdot b_k) b_k - \sum_{k=1}^{j-1} (x_j^{p-1} \cdot x_k^p) x_k^p$ If $z_j \ne \vec{0}$ then let $x_j^p = \frac{z_j}{\|z_j\|}$ Else let $x_j^p = z_j$ end For Let $X_i^p = \{x_j^p, 1 \le j \le r_i^{p-1} | x_j^p \ne \vec{0}\}$ Let $r_i^p = |X_i^p|$ end For.

30. A storage means fabricated to contain a set of instructions corresponding to the method of claim 26.

31. A method for identifying a subset of a corpus of speech data usable for estimating speech parameters in a speech processing application, said corpus being arranged as a plurality of ordered word sets, said word ordering being in accordance with a known ordering methodology, said method comprising the steps of:

constructing feature vectors corresponding to all phonetic segments appearing in said corpus;

mapping said feature vectors into a plurality of matrices based on a model chosen to fit said corpus, said matrices being arranged to include sets of said feature vectors corresponding to word sets in said corpus; and operating on said parameter space matrices with a greedy algorithm to find a submatrix of full rank, said full-rank submatrix being formed by the union of one or more of said model-based matrices and whereby word sets corresponding to said one or more of said model-based matrices included in said full-rank submatrix comprise said subset of said corpus of speech data;

wherein an articulation of one or more of said corresponding word sets provides an input to said speech processing application for estimation of said speech parameters.

* * * * *